US005676244A

United States Patent [19]

Green et al.

[11] Patent Number: 5,676,244

[45] Date of Patent: Oct. 14, 1997

[54] FOOD CONTAINER

[76] Inventors: Robert Green, 261 Fonds La., Westbury, N.Y. 11590; Brendan Wagner, 55 Parkside Dr., Levittown, N.Y. 11756

[21] Appl. No.: 416,157

[22] Filed: Apr. 4, 1995

[51] Int. Cl.[6] ..... B65D 85/72

[52] U.S. Cl. ..... 206/221; 206/542; 220/502; 426/115; 426/120

[58] Field of Search ..... 206/219, 221, 206/222, 541, 542, 546; 220/501, 502, 505, 529; 426/112, 115, 120

[56] References Cited

U.S. PATENT DOCUMENTS

| | | | |
|---|---|---|---|
| 2,980,540 | 4/1961 | Turpin | 206/221 |
| 3,025,948 | 3/1962 | Appelt | 206/546 |
| 3,679,093 | 7/1972 | Chang | 206/542 |
| 4,779,722 | 10/1988 | Hall | 206/221 |
| 4,794,008 | 12/1988 | Schmidt et al. . | |
| 4,930,637 | 6/1990 | DeRoseau | 206/541 |
| 4,951,866 | 8/1990 | Rusnak . | |
| 5,009,310 | 4/1991 | Finney . | |
| 5,012,971 | 5/1991 | Cozzi et al. . | |
| 5,167,973 | 12/1992 | Snyder | 426/120 |
| 5,188,234 | 2/1993 | Fukuda et al. | 208/546 |
| 5,209,348 | 5/1993 | Schafer, III . | |
| 5,241,835 | 9/1993 | Ascone . | |
| 5,312,014 | 5/1994 | Hamlin | 220/501 |

*Primary Examiner*—Jimmy G. Foster
*Attorney, Agent, or Firm*—Daniel L. Gobetz

[57] ABSTRACT

The present invention relates to a container for storing a quantity of cereal and milk, the container including an upper section, a lower section, a partition separating the upper and lower sections, and a spoon. The upper section has a vent hole therein. The lower section defines a second cavity dimensioned to contain a quantity of cereal therein. The lower section has two channels formed therein, the channels having a wide end and a narrow end. The partition is secured to the upper section forming a milk cavity for holding a quantity of milk therein. The partition is provided with a pair of ports therethrough which are adapted to permit the flow of milk out from the milk cavity. The partition is equipped with a pair of post members formed thereon. The post members have bulb shaped post heads at one end which are adapted to be received in the wide end of the channels in the lower section to releasably secure the two sections together. The spoon is releasably secured within a track on the underside of the partition. The spoon serves dual functions. The first function of the spoon is to gate the ports on the partition. The second function of the spoon is to assist the user in eating the contents of the container.

10 Claims, 3 Drawing Sheets

FOOD CONTAINER

BACKGROUND OF THE INVENTION

1. Field of the Invention

The present invention relates to food containers. More particularly, the present invention relates to a container for storing and mixing cereal and milk within the container.

2. Description of the Prior Art

A popular breakfast food for young and old alike is that of dry cereal with milk. This food is typically prepared by putting the dry cereal into a cereal bowl, and then adding refrigerated milk to the cereal at the time of breakfast.

This method of preparing cereal leads to spilled cereal and milk when small children attempt to prepare their own breakfasts without the aid of adults, who may be sleeping or otherwise not available. If the meal was packaged such that the ingredients were conveniently stored in one container, thereby avoiding the need for the child to allocate the milk or cereal, the parents could enjoy their sleep without the fear of spills.

Not only is the cereal and milk mixture a food which is desired by children, but also by a significant amount of teenagers and adults. As cereal is typically eaten for breakfast when teenagers are rushing to get ready for school, and when parents are racing off to work, a single disposable container having both the milk and cereal stored therein in proper proportions, would be highly desirable. The provision of a disposable spoon attached to the container would also be highly desirable as it would provide convenience to the user who would like to place the container in a school bag, briefcase, or other carry bag for future access and consumption.

With the increasing popularity of milk which does not require refrigeration, for example, Parmalat™ brand milk, a container which can safely seal and store its' contents at temperatures ranging from freezing up to above room temperature would be highly desirable. A container having such temperature flexibility would be advantageous to hikers, campers, sportsman as well as the average worker or student who may not have access to refrigeration.

It is therefore an object of the present invention to provide a single container for storing cereal and milk in separate compartments.

It is a further object of the present invention to provide a container which is disposable, and which is equipped with a disposable utensil for eating the food stored therein.

Another object of the present invention is to provide a container which can safely seal and store food contents at varying temperatures.

It is yet another object of the present invention to provide a container which can be easily manipulated by the user to mix the ingredients therein together without the likelihood of a spill.

Numerous innovations for cereal and milk containers have been provided in the prior art. Even though these innovations may be suitable for the specific individual purposes to which they address, they differ from the present invention as hereinafter contrasted.

SUMMARY OF THE INVENTION

The present invention includes a container for storing a quantity of cereal and milk which includes a upper section, a lower section, a partition separating the upper and lower sections, and a spoon. The upper section includes a side wall, the side wall including an upper surface, the upper surface having a vent hole therein. The lower section has a side wall, the side wall including an upper surface. The side wall defines a second cavity dimensioned to contain a quantity of cereal therein. The upper surface has two channels formed therein, the channels having a wide end and a narrow end.

The partition is secured to the upper section forming a milk cavity for holding a quantity of milk therein. The partition is provided with a pair of ports therethrough which are adapted to permit the flow of milk out from the milk cavity. The partition is further equipped with a pair of post members formed thereon. The post members have bulb shaped post heads at one end which are adapted to be received in the wide end of the channels in the lower section to releasably secure the two sections together.

The spoon is releasably secured within a track on the underside of the partition. The spoon serves dual functions. The first function of the spoon is to gate the ports on the partition. The spoon accordingly is equipped with a pair of sized plug members for insertion into respective ports in the partition to selectively gate the ports and control the flow of the milk out from the milk cavity. The second function of the spoon is to assist the user in eating the contents of the container.

A vent seal is removably attached to the upper surface of the first section over the vent hole. The spoon is disposed on the track portion of the partition such that, upon removal of the spoon from the container, milk stored in the upper section will flow through the port into the lower section and mix with the cereal stored therein.

The novel features which are considered characteristic for the food container are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

First Embodiment

10—food container
12—milk section
13—milk cavity
14—cereal section
15—cereal cavity
16—partition
18—spoon
22—side wall
24—upper wall
26—vent hole
28—vent seal
30—side wall
32—upper surface
34—center surface
36—ports
38—posts
39—post heads
40—channel
40A—wide end
40B—narrow end
42—channel
44—slot
46—side wall 48—bottom surface
50—upper surface
51—ridge
52—plug members
54—round end
98—milk
99—cereal
100—cereal-milk mixture Second Embodiment 110—container
112—side wall
114—milk portion
116—lip
118—groove
120—side wall
122—cereal portion

BRIEF DESCRIPTION OF THE PREFERRED EMBODIMENTS

DETAILED DESCRIPTION OF THE PREFERRED EMBODIMENT

Figure 1:
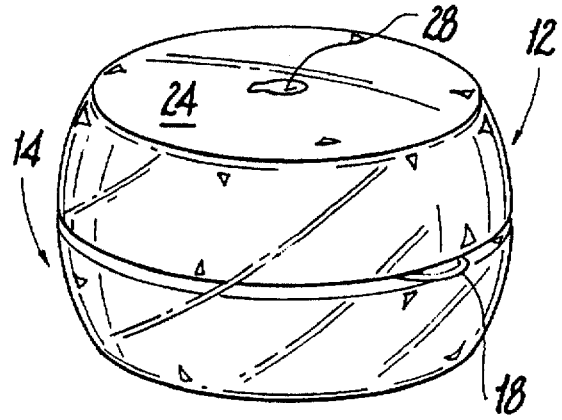
FIG. 1 is a perspective view of a food container constructed in accordance with a first embodiment of the present invention.
Figure 2:
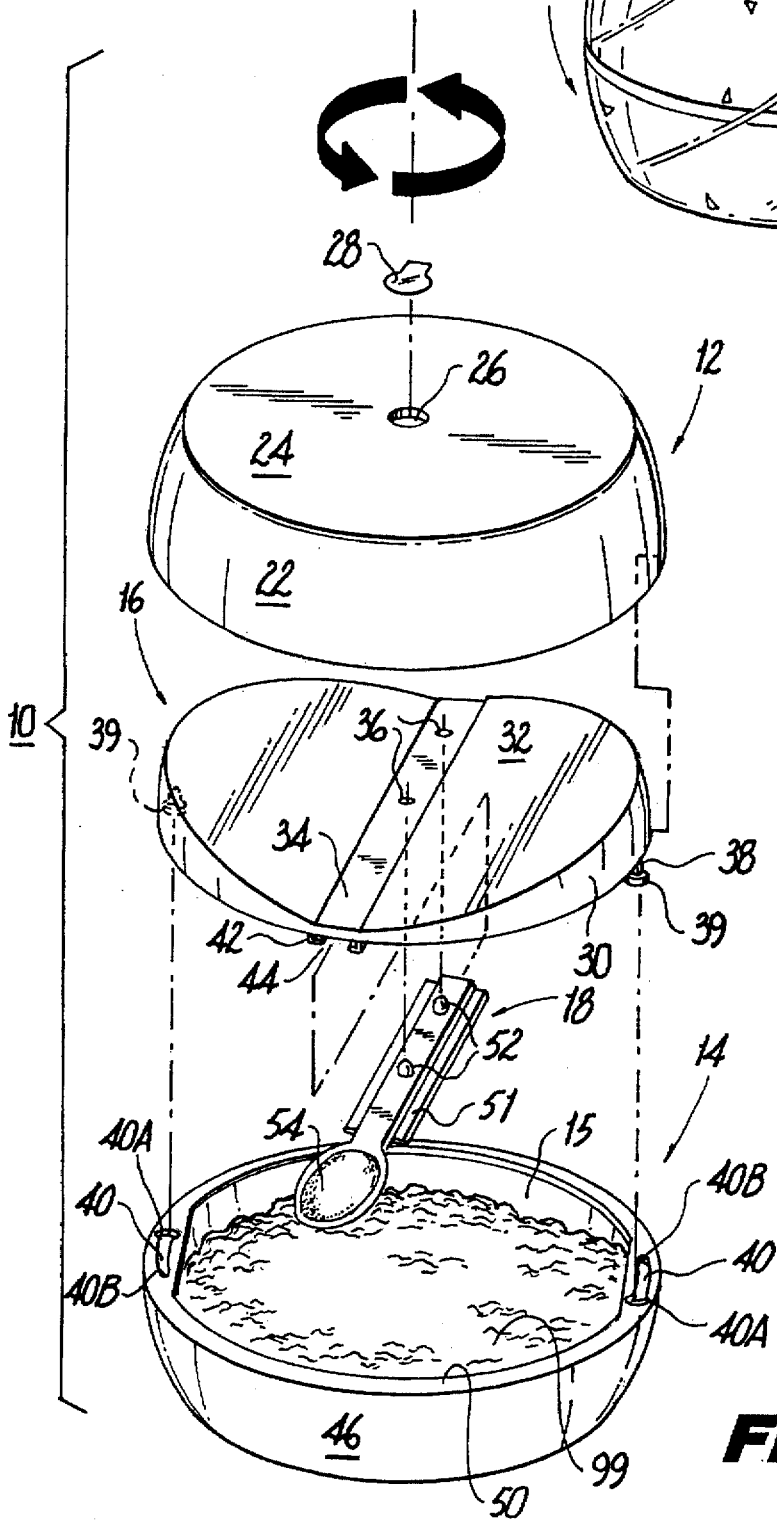
FIG. 2 is a perspective view of the food container of FIG. 1 with parts separated for illustrative purposes.

Firstly, referring to FIG. 1, food container 10 is shown. Referring now to FIG. 2 in conjunction with FIG. 1, container 10 generally comprises four main elements, namely milk section 12, cereal section 14, partition 16, and spoon 18. The four elements are preferably constructed from a durable polymeric material. Although a polymeric material is preferred, it is envisioned that other are suitable materials can be used which can withstand changes in temperatures while safely storing food contents therein.

Figure 3:
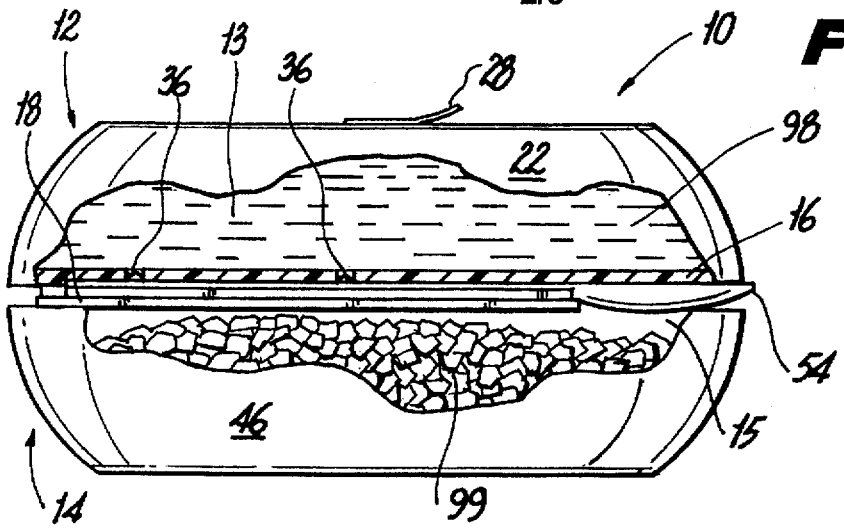
FIG. 3 is cross-sectional view of the food container of FIG. 1 illustrating cereal and milk in separate sections.

Referring now to FIGS. 2–3, milk section 12 includes a milk cavity 13 (FIG. 3.) having a generally circular configuration as viewed from the top of the milk section 12. The milk cavity 13 is defined by a continuous circumferential side wall 22, a substantially flat upper wall 24, and partition 16. Upper wall 24 defines a vent hole 26 therein which when unobstructed permits the free flow of gas between the milk cavity 13 and the exterior of the container 10. A foil vent seal 28 is adhered to the upper wall 24 of the milk section 12 over the vent hole 26. Vent seal 28 is adhered to the upper wall 24 in a known manner such that it can be selectively removed from the upper wall 24 to expose the vent hole 26.

With continued reference to FIGS. 2–3, partition 16 includes a continuous circumferential side wall 30 which is sonically welded to the interior of the side wall 22 of the milk section 12 to form milk chamber 13. Partition 16 includes a sloped upper surface 32 adapted to direct the flow of milk 98 in the milk chamber 13 toward a center surface 34. The center surface 34 defines two ports 36 dimensioned to permit passage of milk 98 therethrough when the ports 36 are unobstructed.

Figure 6:
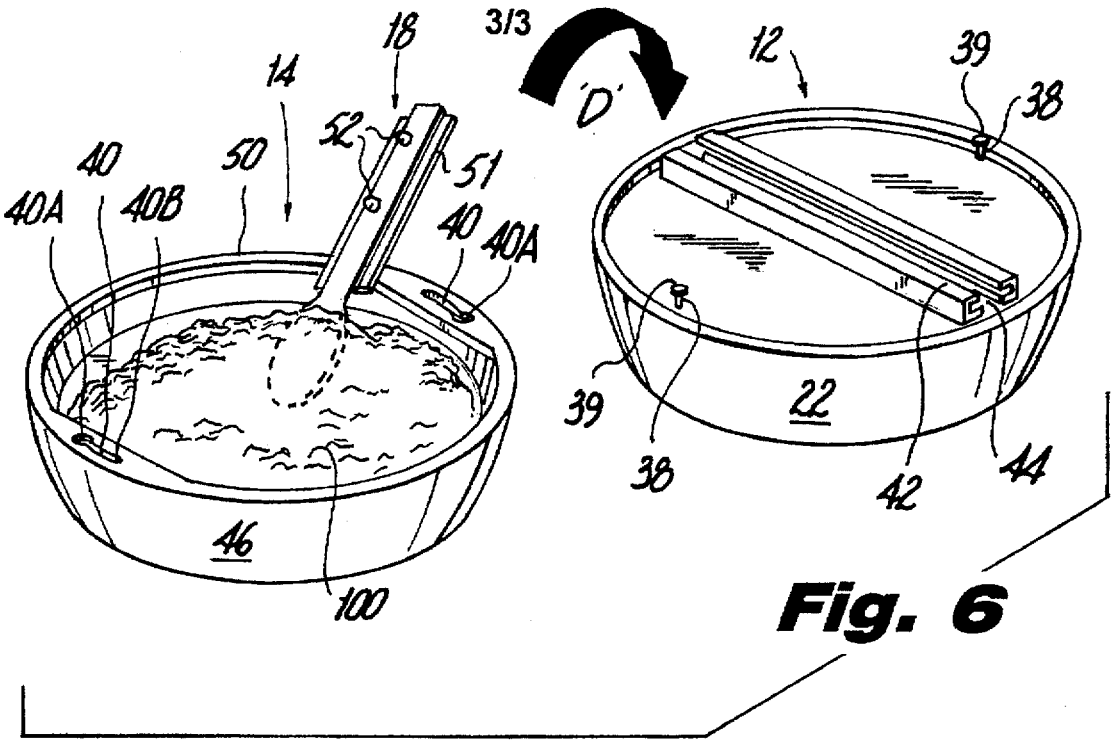
FIG. 6 is a perspective view of the food container of FIG. 1 illustrating the milk section having been removed from the cereal section.

As best seen in FIG. 6, partition 16 further includes a pair of posts 38 extending therefrom forming bulb shaped post-heads 39 at their distal ends. The posts 38 are dimensioned to fit within respective channels 40 in the cereal section 14 to permit the milk section 12 to be twisted on and off the cereal section 14. The manner in which the milk section 12 and the cereal section 14 are releasably secured to one another is described in detail below. Referring once again to FIG. 6, a track 42 is mounted to the partition 16 and defines a slot 44. Slot 44 is dimensioned to receive spoon 18 therein and to permit sliding movement of the spoon 18 therefrom, once again, will be described in detail below.

With continued reference to FIGS. 2–3, cereal section 14 includes a cereal cavity 15 having a generally circular configuration as viewed from the top of cereal section 14. The cereal cavity 15 is defined by an upstanding circumferential sidewall 46, a substantially flat bottom wall 48, and the underside of partition 16. An upper surface 50 of the cereal section 14 includes two channels 40 formed therein. The channels 40 each have a wide end 40A, and a narrow end 40B. The wide end 40A is dimensioned to receive the post heads 39 of the posts 38 into the channel 40. The channel 40 is dimensioned such that the post heads 39 can slide within the channel 40 between the wide end 40 and the narrow end 40, yet restricting insertion and removal of the post heads 39 from the channel 40 to only at the wide end 40A. Thus when the post heads 39 are rotated within the channel 40 toward the narrow end 40B, the post heads 39 become wedged or otherwise friction fitted within the channel 40 and thereby secure the milk section 12 to the cereal section 14. Opposite rotation of the post heads 39 will dislodge the post heads 39 from the narrow end 40B of the channel 40 and move the post heads 39 within the channel 40 to the wide end 40A. With the post heads 39 at the wide end 40A of the channel 40, the milk section 12 can be simply lifted off of the cereal section 14.

Figure 4:
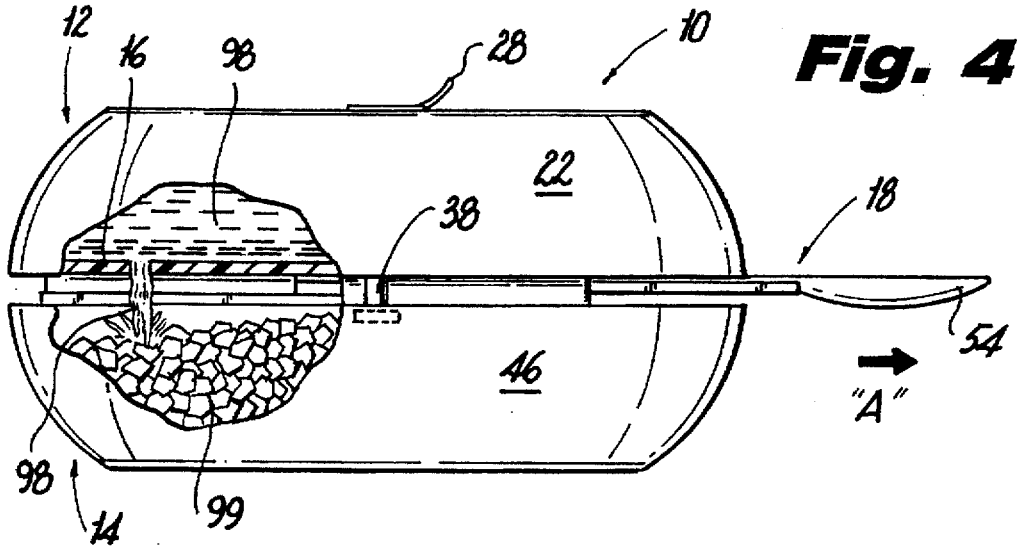
FIG. 4 is a view similar to that of FIG. 3 illustrating the spoon partially removed from the container allowing milk to flow through one port in the partition and to mix with the cereal.
Figure 5:
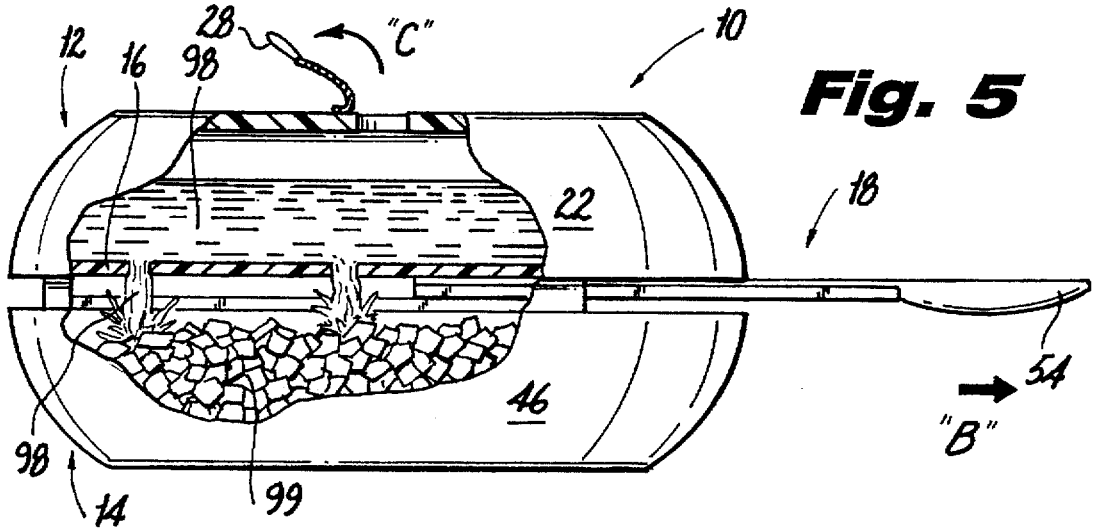
FIG. 5 is a view similar to that of FIGS. 3–4 illustrating the spoon further removed from the container than in FIG. 5, with the vent seal in an open position allowing milk to freely flow through both ports in the partition.

Referring to FIGS. 3–5, the operation of the container will now be described. It is envisioned that the container 10 may be shrink-wrapped or otherwise enveloped by a wrapping material to advertise the product and or aid in preserving the contents therein. Accordingly, when the user of the container 10 desires to mix the milk 98 with the cereal 99, the user first will remove any outer wrapping (not shown). The container 10, as shown in a resting position in FIG. 3, segregates the milk 98 from the cereal 99.

The spoon 18 forms an elongated ridge 51 on either side of the spoon 18. The ridge 51 is dimensioned to slidably fit within the slot 44 in the track 42 of the partition 16. The ridge 51 allows the spoon 18 to be slidably moved within the track 42 and for the spoon 18 to be removed entirely from the container 10. Plug members 52 are provided on the spoon 18 and extend up therefrom. The plug members 52 are sized to and spaced for respective positioning within the ports 36 in the partition 16 when the spoon 18 is in a fully inserted position as shown in FIG. 3. The spoon 18, when in this fully inserted position, prevents the milk 98 from seeping into the cereal section 14. A round end 54 of the spoon 18 is positioned such that the user can grasp the round end 54 to withdraw the spoon 18 from the container 10.

Referring now to FIG. 4, the spoon 18 is shown in an intermediate position wherein the spoon 18 has been partially withdrawn from the container 10. Referring to FIGS. 4–5, as the spoon 18 is withdrawn from the container 10, as indicated by arrows "A" and "B", respectively in FIG. 4 and FIG. 5, the plug members 52 of the spoon 18 are removed from the ports 36 in the partition 16 allowing milk 98 to seep into the cereal section 12. In order to assist the flow of milk 98 into the cereal section 14, the user peels back the vent seal 28 as indicated by arrow "C" to expose the vent hole 28 and allow a free flow of milk 98 into the cereal section 99 as shown in FIG. 5.

Referring now to FIG. 6, with the spoon 18 fully removed from the container 10, the milk section 12 can be removed from the cereal section 14 through counter-clockwise rotation of the milk section 12 about the cereal section 14 to move the posts 38 in the partition to the wider end 40A of the channel 40 in the upper surface 50 of the cereal section 14. The milk section 12 can then be simply lifted off of the cereal section 14 as indicated by arrow "D" in FIG. 6. The spoon 18 can then be used in a known manner by the operator to eat the cereal-milk mixture 100 contained in the cereal cavity 15. When finished eating, the user can simply dispose of the spoon and the container in an appropriate recycling bin.

Figure 7:
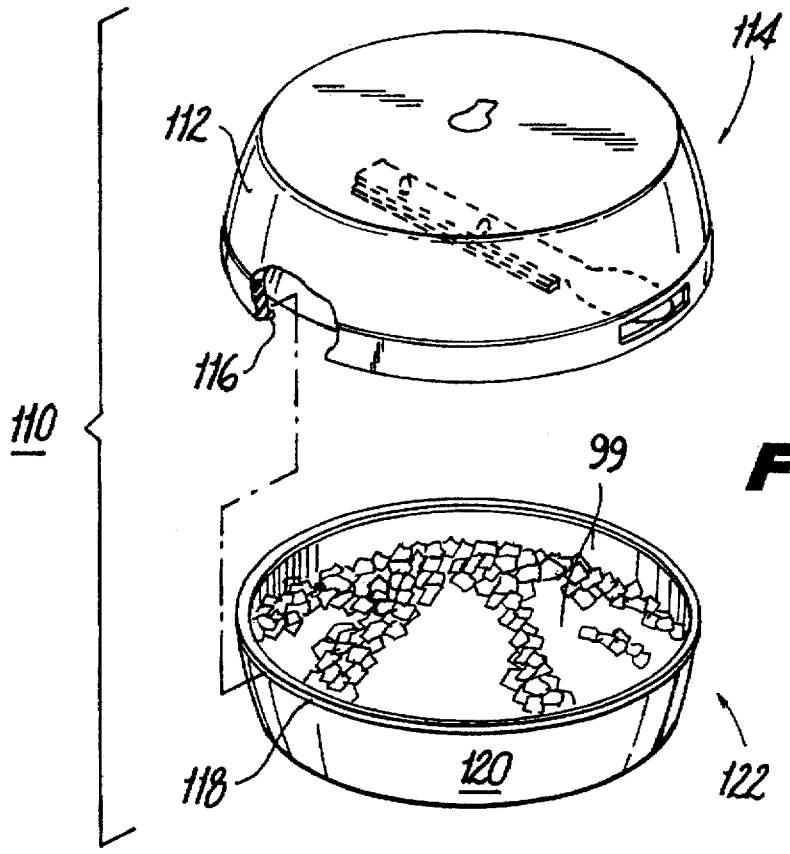
FIG. 7 is a partial cut-away view of a food container constructed in accordance with a second embodiment of the present invention illustrating the lip on the side wall of the milk section and corresponding groove in the cereal section.

Referring now to FIG. 7, a second embodiment of the present invention is shown in container 110. Container 110 is substantially the same in construction as container 10 with the exception of how the sections are attached. The side wall 112 of the milk section 114 of container 110 forms a continuous lip 116. Lip 116 is dimensioned to snap into a corresponding groove 118 formed in the sidewall 120 in the cereal section 122. The lip 116 and groove 118 function in a known manner as found on many products and need not be described in detail herein.

It will be understood that each of the elements described above, or two or more together, may also find a useful application in other types of constructions differing from the type described above.

While the invention has been illustrated and described as embodied in a cereal and milk container, it is not intended to be limited to the contents to be stored therein as shown, since it will be understood that various omissions, modifications, substitutions and changes in the forms and details of the device illustrated and in its operation can be made by those skilled in the art without departing in any way from the spirit of the present invention. For example, it is envisioned that other liquids and solids could be placed in the container for later mixing; for instance, ice cream and syrup, salad and salad dressing, and french fries and ketchup.

What is claimed as new and desired to be protected by Letters Patent is set forth in the appended claims.

I claim:

1. A container for storing a quantity of a liquid food and of a solid food, and for mixing the liquid food and the solid food in the container to form a mixture, comprising:

a) an upper section having a side wall, the side wall including an upper surface;

b) a partition secured to the upper section, the partition and the upper section defining a first cavity for holding the quantity of liquid food therein, the partition having a port therethrough;

c) a lower section having a side wall, the side wall including an upper surface, the side wall defining a second cavity dimensioned to contain the quantity of solid food therein;

d) a spoon releasably secured to the partition for gating the port, wherein upon removal of the spoon from the container, the liquid food stored in the upper section will flow through the port into the lower section and mix with the solid food stored therein; and e) means formed on the upper section and the lower section for releasably securing the upper section to the lower section.

2. The container as described in claim 1 wherein the means for securing the upper section to the lower section comprises at least two post members formed on the partition, and at least two corresponding slots formed in the upper surface of the lower section.

3. The container as described in claim 1 wherein the means for securing the upper section to the lower section comprises a lip formed on the side wall of the upper section, and a groove formed in the side wall of the lower section.

4. The container as described in claim 3, wherein the partition includes a track formed thereon, the track dimensioned and adapted to secure the spoon thereon, the track further adapted to allow the spoon to slide in and out of the track.

5. The container as described in claim 1, wherein the upper surface of the upper section includes at least one vent hole therein, the vent hole in liquid communication with the first cavity.

6. The container as described in claim 5, further including sealing means releasably secured to the upper surface of the upper section over the at least one vent hole for preventing the flow of gas and liquid between the first cavity and the exterior of the container.

7. The container as described in claim 6 wherein the sealing means is a piece of foil adhered to the upper surface of the upper section.

8. The container as described in claim 4 wherein the spoon has a ridge formed thereon which is dimensioned and adpated to fit within the track on the partition.

9. A container for storing a quantity of a liquid food and a solid food, comprising:

a) an upper section having a side wall, the side wall including an upper surface, the upper surface having a vent hole therein;

b) a lower section having a side wall, the side wall including an upper surface, the side wall defining a second cavity dimensioned to contain the quantity of the solid food therein, the upper surface having a two channels formed therein, the channels having a wide end and a narrow end;

c) a partition secured to the upper section, the partition and the upper section defining a first cavity for holding the quantity of solid food therein, the partition having a port therethrough, the partition further having a pair of post members formed thereon adapted to be received in the wide end of the channels in the lower section;

d) a spoon releasably secured to the partition for gating the port;

e) a vent seal removably attached to the upper surface of the first section over the vent hole;

f) wherein upon removal of the spoon from the container, the liquid food stored in the upper section will flow through the port into the lower section and mix with the solid food stored therein; and g) wherein rotation of the partition in a first direction about the lower section slides the posts on the partition within the channels of the lower section toward the narrow ends of the channels to secure the upper section to the lower section, and wherein rotation of the partition in a second direction about the lower section releases the upper section from the lower section.

10. The container as described in claim 9, wherein the spoon includes a pair of plug members extending therefrom, the plug members dimensioned and adapted to plug the ports in the partition when the spoon is fully inserted on the track in the partition.

* * * * *